United States Patent [19]

Takasu et al.

[11] 4,258,116

[45] Mar. 24, 1981

[54] PROCESS FOR DEVELOPING ELECTROSTATIC LATENT IMAGES

[75] Inventors: Yoshio Takasu, Toride; Takashi Hino, Tokyo, both of Japan

[73] Assignee: Canon Kabushiki Kaisha, Tokyo, Japan

[21] Appl. No.: 968,205

[22] Filed: Dec. 11, 1978

[30] Foreign Application Priority Data

Dec. 22, 1977 [JP] Japan ..... 52/154630

[51] Int. Cl.[3] ..... G03G 13/08

[52] U.S. Cl. ..... 430/102; 430/101; 430/106; 430/109; 430/110; 118/653

[58] Field of Search ..... 430/101, 102, 120, 903, 430/109, 110, 106

[56] References Cited

U.S. PATENT DOCUMENTS

| | | | |
|---|---|---|---|
| 3,166,419 | 1/1965 | Gundlach | 430/101 X |
| 3,166,432 | 1/1965 | Gundlach | 430/120 |
| 3,332,396 | 7/1967 | Gundlach | 430/101 X |
| 3,852,208 | 12/1974 | Nagashima et al. | 430/109 |
| 3,908,037 | 9/1975 | Bickmore | 430/101 |
| 3,997,688 | 12/1976 | Gundlach | 430/101 X |

*Primary Examiner*—Roland E. Martin, Jr.

*Attorney, Agent, or Firm*—Fitzpatrick, Cella, Harper & Scinto

[57] ABSTRACT

Electrostatic latent images are developed by closely positioning a developer carrying member having on a surface a developer composed of fine particles containing an organic semiconductor and being insulating at a normal state adjacent to an electrostatic latent image bearing surface in such a manner that the surface provided with the developer of the developer carrying member facaes the electrostatic latent image bearing surface, and thereby electric charges which are opposite in polarity to the electric charges of the electrostatic latent images being injected into the developer from the developer carrying member by an electric field formed between the electrostatic latent image bearing surface and the developer carrying member and the electrostatic latent images being developed by the developer.

11 Claims, 3 Drawing Figures

PROCESS FOR DEVELOPING ELECTROSTATIC LATENT IMAGES

BACKGROUND OF THE INVENTION

1. Field of the Invention

This invention relates to a process for developing electrostatic latent images which may be produced by electrophotographic methods or electrostatic recording methods and an apparatus therefor.

2. Description of the Prior Art

Heretofore, there have been known various photographic methods, recording methods and printing methods which comprise forming electric latent images (electrostatic latent images) and visualizing the latent images by using colored fine particles called "toner", in the field of image forming techniques.

For example, representative electrophotographic methods are disclosed in U.S. Pat. Nos. 2,297,691; 3,666,363; and 4,071,361. In general, electrophotographic methods are conducted by forming electric latent images on a photosensitive member composed of a photoconductive material, developing the latent image with a toner, if desired, transferring the toner images to a receiving member such as paper, and fixing the toner images by heat, pressure or a solvent vapor to produce copies. As a method for visualizing electrostatic latent images with a toner, there may be mentioned a magnetic brush developing method as disclosed in U.S. Pat. No. 2,874,063, a cascade developing method as disclosed in U.S. Pat. No. 2,618,552 and a powder cloud developing method as disclosed in U.S. Pat. No. 2,221,776.

Developers used for these developing methods may be divided into two groups, that is, one component system and two component system.

A one component system developer is composed of colored fine particles (toner) capable of being selectively attracted or repulsed by an electrostatic charge. A two component system developer is composed of the colored fine particles (toner) and a carrier material such as iron powders, glass beads and the like.

The one component system developer can develop electrostatic latent images by electric charges induced by a conductor such as a magnetic metal sleeve for carrying the developer while the two component system developer can develop electrostatic latent images by triboelectric charges.

Among various dry developing methods, as a developing method using a one component system developer, there is known a charge induction developing method, for example, as disclosed in U.S. Pat. No. 3,166,432. The charge induction developing method comprises attaching conductive toner particles to a developer dispensing member and contacting the developer dispensing member carrying the toner particles with an electrostatic latent image bearing surface to develop the latent images.

According to this developing method, when the toner particle layer on the developer dispensing member faces the electrostatic latent images, electric charges which are opposite in polarity to the electric charges of the electrostatic latent images are induced in the toner particles because the toner particles are conductive, and the resulting electric attraction between the electrostatic latent images and the oppositely charged toner particles carries out the development of the latent images.

In such charge induction developing method, since the developer is composed of toner particles only, it is not necessary to control the mixing ratio (i.e. concentration of toner) of toner particles and a carrier material and further an agitating procedure for charging the developer is not necessary so that the developing device can be simple and small in size. Neither occurs degradation of the developed image quality which is often caused by deterioration of a carrier as time passes away.

Though charge induction developing methods have the above mentioned advantages, the methods have been heretofore, practically used only for a process comprising forming electrostatic latent images on a photosensitive paper having a coating of a photosensitive material such as zinc oxide and the like, directly developing the latent images and fixing the developed images.

However, in the field of the image forming techniques thee have been recently used widely copying processes containing a step in which developed images are transferred to a receiving material (for example, ordinary paper), and it is very difficult to apply the above mentioned charge induction developing method to such copying processes and moreover there are various disadvantages. In other words, an electrostatic transferring procedure of developed images is effected with difficulty because a conductive toner is used.

For example, when a corona transfer method is conducted using a conductive toner (a corona transfer method comprises contacting toner images on an electrostatic latent image bearing member with a receiving material and charging from the rear side of the receiving material by corona discharge to transfer the toner images to the receiving member), the toner particles are charged in the same polarity as the receiving member by a slight corona electric current passing through the receiving material. As the result, the transfer is not sufficiently effected and moreover the developed images become irregular by the repulse between the toner particles because the whole toner layer is charged in the same polarity.

SUMMARY OF THE INVENTION

An object of the present invention is to provide a new developing process free from the above mentioned disadvantages of dry developing processes employing a one component system developer.

Another object of the present invention is to provide a new developing process which is highly efficient and gives developed images of good quality.

A further object of the present invention is to provide a new developing process which enables to conduct the subsequent transfer step efficiently within a short time with a high precision.

Still another object of the present invention is to provide an apparatus suitable for conducting the above mentioned process for developing electrostatic latent images.

A still further object of the present invention is to provide a new developing apparatus in which developed images of good quality are efficiently produced by using a one component system developer.

Still another object of the present invention is to provide a developing apparatus suitable for conducting the subsequent transfer step efficiently within a short time with a high precision.

According to the present invention, there is provided a process for developing electrostatic latent images which comprises closely positioning a developer carrying member having on a surface a developer composed of fine particles containing an organic semiconductor and being insulating at a normal state adjacent to an electrostatic latent image bearing surface in such a manner that the surface provided with the developer of the developer carrying member faces the electrostatic latent image bearing surface, and thereby electric charges which are opposite in polarity to the electric charges of the electrostatic latent images being injected into the developer from the developer carrying member by an electric field formed between the electrostatic latent image bearing surface and the developer carrying member and the electrostatic latent images being developed by the developer.

According to another aspect of the present invention, there is provided an apparatus for developing electrostatic latent images which comprises a developer carrying member and a developer layer overlying the developer carrying member, the developer being insulating at a normal state, and the developer carrying member being capable of injecting electric charges which are opposite in polarity to electric charges of electrostatic latent images to be developed into the developer when the developer carrying member is closely positioned adjacent to an electrostatic latent image bearing surface and the developer layer faces the electrostatic latent image bearing surface.

DESCRIPTION OF THE PREFERRED EMBODIMENT

A feature of the developing process of the present invention resides in using a developer composed of fine particles (toner) containing an organic semiconductor and being insulating at a normal state. The fine particles may be colored ones. The normal state means a state where an electric field is not applied.

After developing, the toner can be stably transferred to a receiving member by an electrostatic transfer to give good quality of images and furthermore the toner particles show a high fluidity because the toner particles hardly have electric charge at a normal state, and thereby the handling is very easy and excellent.

The present inventors have found that electric resistance of the toner used in the present invention is substantially in a region of that of insulating material, but when the toner is contacted with a substrate such as a certain conductive metal or an inorganic semiconductor and an electric field exceeding a threshold value is applied, electric charges of one polarity are injected into the toner from the substrate.

This discovery was made by the following experiment. For example, a thin film of poly-9-vinylcarbazole, an organic semiconductor, of 8.0 microns in thickness was prepared, contacted with various substrates composed of metals or inorganic semiconductors, and an electric voltage was impressed to the thin film in the direction of the thickness to investigate the charge injection characteristics. The results are as illustrated in FIG. 1.

Figure 1:
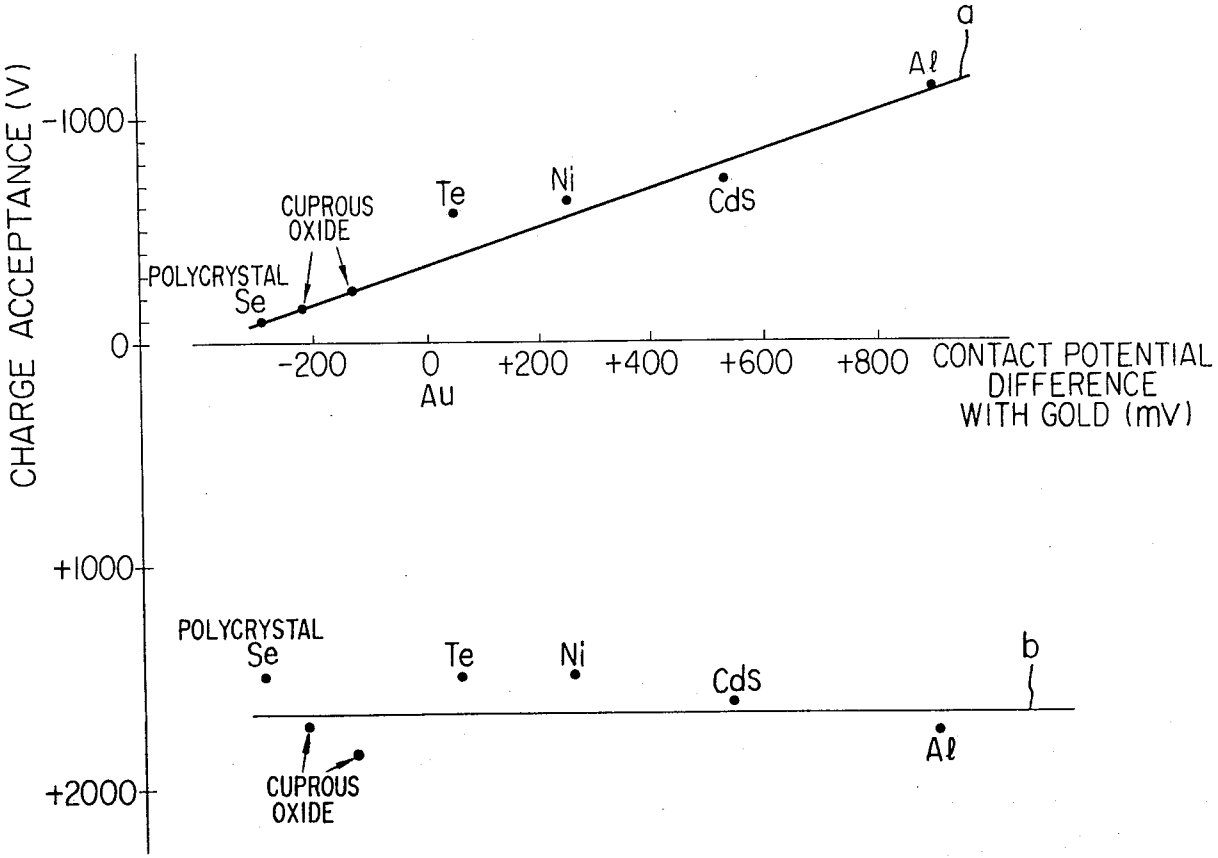
FIG. 1 is a graph in which charge acceptance is plotted against contact potential difference with gold with respect to poly-9-vinylcarbazole (a kind of organic semiconductors) used in the present invention.

Curve (a) in FIG. 1 shows the result when the voltage impression was effected by a negative corona charging device to charge negatively while curve (b) in FIG. 1 shows the result when the voltage impression was effected by a positive corona charging device to charge positively. The abscissa corresponds to a contact potential difference between each substrate and gold (Au) measured by a low level surface potentiometer having a gold electrode. The ordinate corresponds to a saturated charge acceptance resulting from charging a contact laminate composed of a substrate and a poly-9-vinylcarbazole thin film with ±6 KV of corona impression voltage.

The substrates were prepared as shown below. Cadmium sulfide and tellurium were formed on a brass plate by vacuum deposition, nickel was plated, and selenium was vacuum-deposited followed by heat treatment at 80° C. for 10 minutes to convert to polycrystal selenium. Copper was vapor-deposited followed by heat treatment in air at 160° C. for 2 minutes to convert to cuprous oxide.

Referring to FIG. 1, the positive charge acceptance is substantially the same regardless of kinds of the substrate while the negative charge acceptance varies depending upon the contact potential difference between gold and the substrate.

The negative charge acceptance here decreases as the contact potential difference changes to the negative value. Therefore, it is considered that in such substrate, holes are effectively injected into poly-9-vinylcarbazole depending upon the electric field to eliminate the charge acceptance. In other words, when a substrate contacting the poly-9-vinylcarbazole is appropriately selected and a voltage is impressed by maintaining the substrate at a positive polarity, holes are easily injected to the poly-9-vinylcarbazole, and in an electric field opposite in polarity to the above one there occurs no injection of electron and the poly-9-vinylcarbazole behaves completely as an insulating material.

In short, the present invention is concerned with a developing process in which such characteristics of organic semiconductor are utilized.

FIG. 1 shows that the above mentioned phenomena are remarkable when polycrystal selenium or cuprous oxide is used as the substrate. Therefore, when toner particles containing an organic semiconductor such as poly-9-vinylcarbazole (there exists an organic semiconductor at least on the surface of the toner particles) is in contact with and is carried on a substrate composed of poly-crystal selenium, cuprous oxide or the like and the toner particles are closely positioned adjacent to a negatively charged electrostatic latent image and are placed in face-to-face relation, holes are injected to the toner particles by the electric field thus formed and developable charges can be maintained.

As a material constituting a substrate, a material which has a negative contact potential with respect to gold is desirable, but only few metals are of such contact potential.

Some literatures indicate that work function of nickel is larger than that of gold, but according to the present inventors' experiment, a contact potential difference between gold and nickel is +250 mV and nickel shows a high negative charge acceptance, and therefore, it has been found that nickel does not have a remarkable effect on the above mentioned action.

it is difficult to obtain a material having a large work function by using metals, but such material can be obtained by using inorganic semiconductors. The top portion of valence band of most inorganic semiconductors is located lower than Fermi level of metals. Therefore, when such inorganic semiconductors are used as a surface material which contacts the above mentioned particles, it is very easy to inject holes into toner particles containing an organic semiconductor such as poly-9-vinylcarbazole.

According to the present invention, in addition to polycrystal selenium or cuprous oxide, there may be used p-type cadmium telluride, p-type silicon, p-type lead sulfide, p-type copper sulfide and the like which give the same effect as polycrystal selenium and cupric oxide.

When a surface contacting toner particles is made of such inorganic semiconductor, charges are effectively injected into the toner particles according to the present invention.

The present invention also provides an apparatus for carrying out a developing process utilizing a unique action between an organic semiconductor and an inorganic semiconductor.

The developer, toner particles, used in the present invention may be produced by the following methods. When the organic semiconductor is a high polymer, a colorant such as dyes and pigments is directly added to the high polymer, kneaded and made into fine particles to produce a toner. When the organic semiconductor itself does not have shapeability, toner particles are made by combining with an appropriate binder. As the binder, there may be used various resins used for conventional electrophotographic toners such as polystyrene, chlorinated paraffin, polyvinyl chloride, phenolic resins, epoxy resins, polyamides, polyesters, polyacrylic acid resins, polyethylene, polypropylene, and similar polymers and copolymers.

These resins may be used alone or in combination.

To the resin are added an organic semiconductor and a colorant such as known dyes and pigments, and these are premixed by a vibrating mill. The resulting powders are melted and kneaded by a roll mill, roughly ground by a hammer mill, then finely pulverized and the particles of about 5–20 microns in size are used as a toner.

Alternatively, a toner may be produced by coating conductive particles containing a large content of conductive fine particles such as metal, magnetite, carbon black and the like with a layer of a resin material containing an organic semiconductor in the thickness of about 2 microns.

Anyway, the toner used in this invention should be insulating at a normal state and charges should be injected into the toner from the developer carrying member by electric field given by electrostatic latent images upon development.

Furthermore, it is necessary for injecting charges into toner particles that the organic semiconductor contacts the developer carrying member. Therefore, where a toner is prepared by adding an organic semiconductor to a binder resin, content of the organic semiconductor in toner particles is preferably not less than 0.1 part by weight per 100 parts by weight of a binder resin, more preferably not less than 1 part by weight per 100 parts by weight of a binder resin.

Representative organic semiconductors used in the present invention which can effectively control characteristics of toners are as shown below.

(A) Vinylcarbazoles, for example, vinylcarbazole, poly-9-vinylcarbazole, 9-vinylcarbazole copolymer, 3-nitro-9-vinyl-8-aminocarbazole, 3-N-methylamino-9-vinylcarbazole copolymer, nitrated poly-9-vinylcarbazole, poly-9-vinylcarbazole copolymer, halogen substituted vinylcarbazole, 3,6-dibromo-9-vinylcarbazole copolymer, brominated poly-9-vinylcarbazole, 3-iodo-9-vinylcarbazole copolymer, poly-3,6-diiodo-9-vinylcarbazol, poly-3-benzylideneamino-9-vinylcarbazole, poly-9-propenylcarbazole, 9-vinylcarbazole-ethyl acrylate graft copolymer (molar ratio of 90 to 10), vinylanthracene-9-vinylcarbazole copolymer, and homopolymer or copolymer of 2-(or 3-) vinyl-9alkyl-carbazole where the alkyl is a primary alkyl such as methyl, ethyl, propyl and the like.

(B) Aromatic amino derivatives, for example, aminopolyphenyl, arylazines, N,N'-dialkyl-N,N'-dibenzylphenylene-diamine, N,N,N',N'-tetrabenzyl-p-phenylenediamine, N,N'-diphenyl-p-phenylenediamine, N,N'-dinaphthyl-p-phenylenediamine, and 4,4'-bis-dimethylaminobenzophenone.

(C) Diphenyl or triphenyl series, for example, diphenylmethane dye leuco base, and triphenylmethane dye leuco base.

(D) Heterocyclic compounds, for example, oxadiazole, ethyl carbazole, N-n-hexylcarbazole, 5-aminothiazole, 4,1,2-triazole, imidazolone, oxazole, imidazole, pyrazoline, imidazolidine, polyphenylene thiazole, 1,6-methoxy-phenazine, bis-(N-carbazole)-alkane derivatives, and pyrazolinopyrazoline derivatives.

(E) Compounds having a condensed ring, for example, benzothiazole, benzimidazole, 2-(4'-diaminophenyl)-benzoxazole, 2-(4'dimethylaminophenyl)benzoxable and like benzoxazoles, aminoacridine, quinoxaline, diphenylene hydrazines, pyrrocoline derivatives, and 9,10-dihydroanthracene derivatives.

(F) Compounds having a double bond, for example, acylhydrozone ethylene derivatives, 1,1,6,6-tetraphenylhexatriene, and 1,1,5-triphenyl-pent-1-en-4-in-3-ol.

(G) Condensation products, for example, condensation products of aldehydes and aromatic amines, reaction products of secondary aromatic amines with aromatic halogenated compounds, polypyrromethanoimide, and poly-p-phenylene-1,3,4-oxadiazole.

(H) Vinyl polymers (except polyvinyl-carbazoles), for example, α-alkyl-acrylic acid amide polymers, polyvinyl acridine, poly-[1,5-diphenyl-3-(4-vinylphenyl)-2-pyrazoline], poly (1,5-diphenylpyrazoline), polyacenaphthylene, nuclear substituted polyacenaphthylene, polyvinyl anthracene, and poly-2-vinyldibenzothiophene.

(I) Oligomers, for example, the following oligomers.

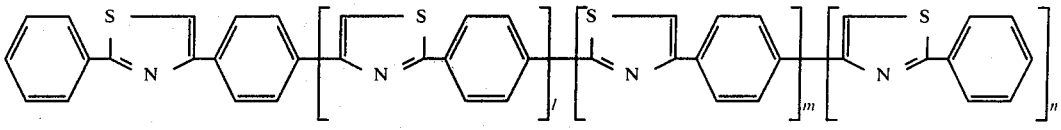

where l, m and n are zero or 1 and $l \geqq m \geqq n$.

An example of the 5-ring compounds is p-bis(2-phenyl-4 thiazolyl) benzene. An example of the 7-ring compounds is 2,4-bis-[4-(2-phenyl-4-thiazolyl)-phenyl] thiazole. And an example of the 9-ring compounds is 1,4-bis[4-{4-(2-phenyl-4-thiazolyl)-phenyl}thiazolyl] benzene.

Other than the above mentioned various compounds, various organic pigments are organic semiconductors as shown below. The numbers in parentheses are Color Index Number in the following unless otherwise specified.

(J) Perylene pigments, for example,
Vat Orange 7 (71105),
C.I. Vat Red 15,
C.I. Vat Red 29 (71140),
C.I. Vat Red 23 (71130),
Paliogene Red GG (supplied by BASF), and
Permanent Red BL (supplied by FH).
(K) Anthraquinone pigments, for example,
C.I. Vat Yellow 20 (68420),
C.I. Vat Yellow 1 (70600),
C.I. Vat Orange 3 (59300),
C.I. Vat Violet 1 (60010),
C.I. Vat Blue 6 (69825),
C.I. Vat Blue 4 (69800),
C.I. 60520,
Helio Fast Yellow E3R (supplied by Boyer), and pyrrocoline.
(L) Thioindigo pigments, for example,
C.I. Vat Red 1 (73385),
C.I. Vat Violet 2, and
C.I. Vat Violet 3 (73395).
(M) Dioxane pigments, for example,
Experimental Dioxazine-Violet Bluish (supplied by Ciba), and
Experimental Dioxazine-Violet Redish (supplied by Ciba).
(N) quinacridone pigments, for example,
C.I. Pigment Violet 19 (46500),
Monastral Scarlet (supplied by Du Pont), and
Monastral Maroon (supplied by Du Pont).
(O) Azo pigments, for example,
C.I. Pigment Orange 5 (12075),
C.I. Pigment Red 5(12490), and
C.I. Pigment Red 9 (12460).
(P) Phthalocyanine pigments, for example,
Heligene Blue (supplied by BASF),
C.I. Pigment Blue 15 (74160),
C.I. Pigment Blue 15 (74250),
C.I. Pigment Green 7 (74260),
C.I. Pigment Green 36 (74265), and
C.I. Pigment Green 36 (74160).

The above mentioned organic pigments may be modified so as to improve the negative charge injecting property by forming complexes with, for example, the following compounds.

2,4,7,8-tetranitrocarbazole,
2,4,7-trinitrocarbazole,
2,4,7,8-tetranitrofluorenone,
2,4,7-trinitrofluorenone,
2,4,7-trinitrofluorenomalononitrile,
tetracyanoquinodimethane,
tetracyanoethylene,
p-chloranil,
p-bromoanil,
iodine,
1,4,6,9-tetranitroanthraquinone, and
α-tribromoacetic acid.

It should be noted that other compounds capable of forming complexes with the organic pigments may be used.

Figure 2:
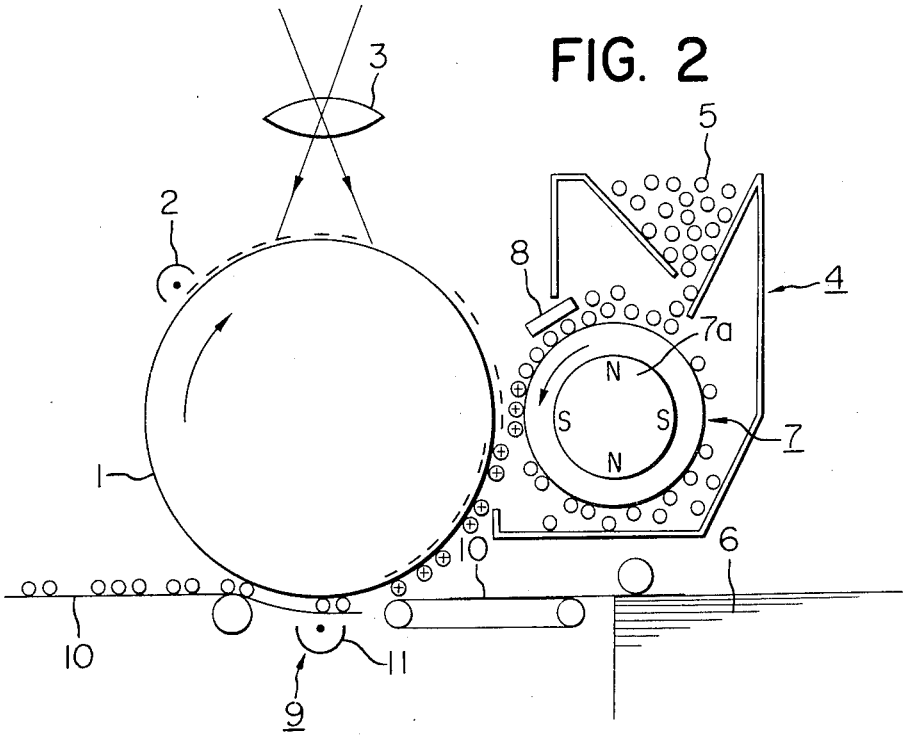
FIG. 2 and FIG. 3 diagrammatically represent copying apparatuses for explaining the developing process according to the present invention.

FIG. 2 illustrates diagrammatically a copying apparatus for forming copied images on ordinary paper. Photosensitive member drum 1 rotates to the direction as indicated by the arrow. Photosensitive member drum 1 is firstly, for example, negatively charged by corona charging device 2, imagewise exposed by optical means 3 to form electrostatic latent images, and then the electrostatic latent images are developed at developing means 4 with the toner of the present invention, that is, toner 5 containing an organic semiconductor. Developing means 4 contains permanent magnet 7*a* and developer carrying member (hereinafter often referred to as "toner dispensing member") 7 is a form of sleeve rotating to the direction of the arrow. Toner, dispensing member 7 is closely positioned adjacent to photosensitive member 1.

Toner dispensing member 7 contains magnet 7*a* for the purpose of imparting magnetism to toner 5 in advance and making the holding of toner particles sure.

Though the present invention is not limited to the above mentioned embodiment, magnetism is practically advantageous, sure and easy for maintaining stably toner 5 on the surface of toner dispensing member 7.

Further, the surface of toner dispensing member 7 is composed of an appropriate material which can inject charges opposite in polarity to the latent images into toner 5.

Figure 3:
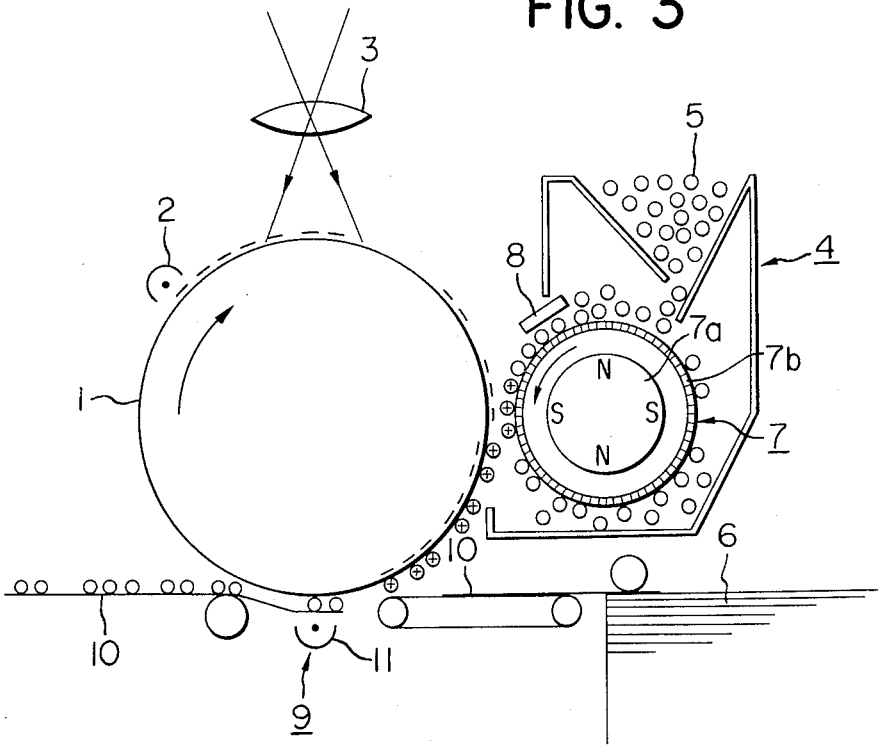

For example, it is preferable that, as in FIG. 3, coating 7*b* composed of an inorganic semiconductor such as polycrystal selenium and the like is formed at the surface of toner dispensing member 7.

Toner 5 maintained on toner dispensing member 7 is transferred toward photosensitive member drum 1 and an amount of toner can be controlled by doctor blade 8. At a position where a latent image on photosensitive member drum 1 is brought sufficiently near to toner dispensing member 7, charges are injected into toner 5 on the surface of toner dispensing member 7 by electric field formed between the latent image and the toner dispensing member and the latent image is developed with toner 5 by the injected charges.

The developed image thus obtained is insulating at a normal state so that it can be easily and exactly transferred to a receiving member by, for example, a corona transferring method. After developement, the surface portion of photosensitive member drum 1 moves to transfer means 9 where the developed toner image is efficiently transferred to ordinary paper 10, a receiving member, fed from paper supplying device 6 by electrostatic means such as corona charging device 11.

According to the present invention, the toner contains an organic semiconductor. Some organic conductors have photoconductivity and therefore, the transferring portion should be shielded from light when a toner containing such organic semiconductor is used.

Further, in the present invention it is not so important whether or not the toner contacts the latent images, and the present invention can be carried out in both cases. However, it is necessary to generate a relatively strong electric field between the surface of toner dispensing member 7 and an electrostatic latent image bearing surface and therefore it is desirable to bring them as near as possible without contacting them. In practice, the gap between them is in a range of from about 50 microns to 5 mm.

In FIG. 2 and FIG. 3, the latent images are negatively charged and positive charge is injected into the toner, but positively charged latent images also can be developed by appropriately selecting an organic semiconductor for toner so as to inject negative charges. Anyway, it is possible to develop electrostatic latent images by selecting a toner composition depending upon polarity of the electrostatic latent images and injecting charges from the toner dispensing member into the toner under electric field.

As shown in the FIGS. above, the present invention enables one component system developers to develop electrostatic latent images and transfer the developed images easily and exactly while such developement and transferring are very difficult for conventional one component system developers. Therefore, the apparatus can be simplified and its size can be reduced.

In addition, the developing method of the present invention can solve a drawback such as degradation of image quality due to deterioration of carrier which is the case when conventional two component developers are employed.

The following examples are given for the purpose of illustration and not by way of limitation.

EXAMPLE 1

Several samples of developers were prepared as shown below.

(1) Poly-9-vinylcarbazole (tradename, Luvican M-170, supplied by BASF) was pulverized to an average particle size of 2.7 microns by a jet mill pulverizer. 10 Parts by weight of poly-9-vinylcarbazole, 40 parts by weight of polystyrene (tradename, Piccolastic) D-125, supplied by ESSO), 20 parts by weight of magnetite (tradename, EPT 1000, supplied by Toda Kogyo.), and 1 part by weight of carbon black (tradename, Regal 400R, supplied by Cabot) were melted and kneaded in a roll mill and then pulverized to an average particle size of 11.5 microns. The developer thus produced is called "Toner Sample No. 1".

(2) 100 Parts by weight of a 10% (by weight) solution of poly-9-vinylcarbazole (tradename, Luvican M-170, supplied by BASF) in methylene chloride, 4 parts by weight of magnetite (tradename, EPT 1000, supplied by Toda Kogyo), and 0.2 parts by weight of carbon black (tradename, Regal 400R, supplied by Cabot) were kneaded in a ball mill for 24 hours. Then the solvent was evaporated to dryness and pulverized to an average particle size of 27 microns. The developer thus produced is called "Toner Sample No. 2".

(3) 100 Parts by weight of polystyrene (tradename, Piccolastic D-125, supplied by ESSO) and 40 parts by weight of magnetite (tradename, EPT-1000, supplied by Toda Kogyo) were kneaded in a roll mill and pulverized to an average particle size of 20 microns. The developer thus produced is called "Toner Sample No. 3". This is not within the present invention, but is prepared for comparison. This developer was placed in an electric resistance measuring cell composed of two aluminum electrodes and a Teflon spacer to measure the electric resistance. The electric resistance was found to be more than $10^{14}\Omega$.cm.

(4) 100 parts by weight of Toner Sample No. 3 as above and 7 parts by weight of carbon black (tradename, Regal 400R, Cabot) were mixed and agitated sufficiently in a hot air stream to form fine particles of Toner Sample No. 3 having carbon black on the surface. The resulting product is called "Toner Sample No. 4", and its electric resistance is about $10^{6}\Omega$.cm.

(5) 100 parts by weight of polystyrene (tradename, Piccolastic D-125, supplied by ESSO), 40 parts by weight of magnetite (tradename, EPT-1000, supplied by Toda Kogyo) and 2 parts by weight of Oil Black BY (supplied by Orient Kagaku Kogyo) were kneaded in a conventional way and pulverized to an average particle size of 20 microns. The developer thus produced is called "Toner Sample No. 5". This toner can be positively charged by triboelectrification. Toner Sample No. 3–No. 5 are not within the scope of the present invention, but are prepared for comparison.

The apparatus as illustrated in FIG. 2 was used for copying with the developers as prepared above. The photosensitive drum 1 is composed of a zinc oxide photosensitive paper wound around a drum and negatively charged electrostatic latent images are produced by charging means 2 and optical means 3.

At the developing device 4, toner dispensing member 7 in a form of a magnetic sleeve has, on the surface, a toner layer of 50–70 microns in thickness by magnetism and rotates in such a way that the toner dispensing member is adjacent to and faces photosensitive drum 1 having electrostatic latent images. The gap between toner dispensing member 7 and photosensitive drum 1 is 120 microns and the toner particles move toward the electrostatic latent images as a jumping phenomenon. The surface of toner dispensing member 7 is made by vapor-depositing copper on an aluminum substrate and heating in air to form cuprous oxide. Both toner dispensing member 7 and photosensitive drum 1 are grounded. Transferring is carried out by a negative corona charging device 11.

According to the above mentioned procedures, Toner Sample No. 1–No. 5 were used for copying and the resulting image quality was compared and triboelectric charge of toners during development was investigated. The results are shown in Table 1 below.

TABLE 1

| Toner Sample No. | Triboelectrification of toner (V) *1 | Image quality: First copy D max *2 | First copy D fog *3 | Hundredth copy D max | Hundredth copy D fog | Note |
|---|---|---|---|---|---|---|
| 1 | −0.5 | 1.20 | 0.05 | 1.19 | 0.05 | |
| 2 | 0 | 1.30 | 0.05 | 1.31 | 0.06 | |
| 3 | −0.8 | 0.20 | 0.08 | 0.22 | 0.09 | |
| 4 | 0 | 0.09 | 0.05 | 0.09 | 0.05 | Transferring was impossible. |

TABLE 1-continued

| Toner Sample No. | Triboelectrification of toner (V) *1 | Image quality First copy D max *2 | First copy D fog *3 | Hundredth copy D max | Hundredth copy D fog | Note |
|---|---|---|---|---|---|---|
| 5 | +35.0 | 1.10 | 0.07 | 0.32 | 0.21 | Toner was fixed to the toner dispensing member. |

*1 Surface potential of a toner layer overlying a toner dispensing member. It was measured 30 seconds after 10 rotations of the toner dispensing member.
*2 Maximum density of transferred images.
*3 Fog density of transferred images.

As is clear from Table 1 above when Toner Sample No. 1 and No. 2 are used, development can be affected though triboelectrification of toner is hardly caused. Therefore, charges held by the toner are understood to be injected into from the toner dispensing member. Further, when Toner Sample No. 3, an insulating toner, was used, only images of low density and less sharpness were produced. This seems that only toner particles present very near to the latent images on the surface of the toner dispensing member take part in developement by polarization.

Toner Sample No. 4, a conductive toner, can be used for developement, but can not be transferred.

Toner Sample No. 5, an insulating toner containing a positive charge controlling dye upon triboelectrification, can retain good triboelectric charge caused by the friction with the toner dispensing member or blade 8 or the like and works effectively in developement judging from image quality of the first sheet of copy. However, as number of the copy sheet increases, the toner particles get gradually fixed to the surface of the toner dispensing member and then newly supplied toner particles can not contribute to developement.

EXAMPLE 2

100 Parts by weight of a 10% (by weight) solution of polyvinylpyrene in methylene chloride and 3 parts by weight of trinitrobenzene were mixed with agitation and the resulting mixture was evaporated to dryness and then finely pulverized. 10 Parts by weight of the resulting fine particles, 40 parts by weight of Piccolastic (tradename, Pycolastic D-125, supplied by ESSO), 20 parts by weight of magnetite (tradename, EPT-1000, supplied by Toda Kogyo), and 1 part by weight of carbon black (tradename, Regal 400R, supplied by Cabot) were melted and kneaded in a roll mill and then finely divided to an average particle size of 11.5 microns to produce a developer. This developer was used in an apparatus as mentioned in Example 1 above to develop positively charged electrostatic latent images on a selenium photosensitive member drum. The developed images were of high image quality and corona transferring was conducted easily and exactly.

EXAMPLE 3

5 Parts by weight of a highly brominated copper phthalocyanine, an organic semiconductor, 100 parts by weight of polyester resin (tradename, Atlac 382A, supplied by Kao Atlas Co.) 30 parts by weight of magnetite (tradename, EPT-1000, Supplied by Toda Kogyo) and 5 parts by weight of carbon black (tradename, Regal 400R, supplied by Cabot) were subjected to roll-milling and then finely divided to an average particle size of 20 microns to produce a toner.

This developer was used in an apparatus as mentioned in Example 1 above to develop electrostatic latent images formed on a photosensitive member drum composed of a conductive substrate, a photoconductive cadmium sulfide layer and a transparent insulating layer which were laminated at the above mentioned order. Further, the developed images were transferred onto an ordinary paper by corona transferring to produce sharp transferred images.

EXAMPLES 4–12

Developers having the composition as shown in Table 2 were produced according to the procedure of Example 3.

TABLE 2

| Example No. | Organic Semiconductor (Weight parts) | Insulating resin (Weight parts) | Magnetite (Weight parts) | Carbon black (Weight parts) |
|---|---|---|---|---|
| 4 | C.I. Pigment Violet 19 (10) | Polyester (100) | (25) | (5) |
| 5 | Non-metal phthalocyanine (15) | Polyester (100) | (25) | — |
| 6 | C.I. Pigment Red 5 (15) | Polystyrene (100) | (25) | (3) |
| 7 | C.I. Vat Violet 1 (10) | Polystyrene (100) | (25) | (5) |
| 8 | C.I. Vat Red 29 (20) | Epoxy resin (100) | (25) | — |
| 9 | Copolymer of 9-vinylcarbazole and ethyl acrylate (Molar ratio, 50:50) (100) | — | (25) | (5) |
| 10 | N,N'-dinaphthyl-p-phenylenediamine (5) | Phenolic resin (100) | (20) | (5) |
| 11 | Polyvinylanthracene (10) | Polyethylene (100) | (20) | (5) |
| 12 | 2-(4'-diaminophenyl) benzoxazole (15) | Polyester (90) | (20) | (3) |

The above listed developers were used for copying according to the procedures of Example 1 and there were obtained developed images of good quality though the qualities are somewhat different from one another.

Further, transferring of developed images to ordinary paper was also conducted very well.

EXAMPLES 13–16

Developers having the compositions as shown in Table 3 were prepared according to the procedure of Example 3.

In Table 3, complexes shown in the column of Organic semiconductor of Examples 14 and 15 were produced by dissolving the components in concentrated sulfuric acid and mixing and then pouring into ice water to precipitate.

TABLE 3

| Example No. | Organic semiconductor (Weight parts) | Insulating resin (Weight parts) | Magnetite (Weight parts) | Carbon black (Weight parts) |
|---|---|---|---|---|
| 13 | Nitrated non-metal phthalocyanine (10) | Polystyrene (100) | (25) | (5) |
| 14 | Complex of C.I. Vat | Polystyrene | | |

TABLE 3-continued

| Example No. | Organic semiconductor (Weight parts) | Insulating resin (Weight parts) | Magnetite (Weight parts) | Carbon black (Weight parts) |
|---|---|---|---|---|
| | Yellow 1 and tetranitrocarbazole (1:1) (15) | (90) | (20) | (3) |
| 15 | Complex of Paliogene Red GG (supplied by BASE) and tetracyanoquinodimethane (2:1) (15) | Polyester (90) | (20) | (5) |
| 16 | Nitrated poly-9-vinylcarbazole (20) | Polystyrene (80) | (15) | (5) |

The above listed developers were used in an apparatus as mentioned in Example 1 to develop positively charged electrostatic latent images formed on a photosensitive member drum composed of a conductive substrate, a photoconductive cadmium sulfide layer, and a transparent insulating layer which were laminated at the above-mentioned order. The developed images were transferred onto an ordinary paper by corona transferring and there were obtained sharp transferred images.

EXAMPLE 17

100 Parts by weight of a 10% (by weight) solution of poly-9-vinylcarbazole (tradename, Luvican M-170, supplied by BASF) in methylene chloride, 4 parts by weight of magnetite (tradename, EPT 1000, supplied by Toda Kogyo), and 0.2 parts by weight of carbon black (tradename, Regal 400R, supplied by Cabot) were mixed and kneaded in a ball mill for 24 hours. Then the solvent was evaporated to dryness and finely divided to an average particle size of 20 microns to produce a toner.

The resulting toner was used in a copying apparatus as diagrammatically illustrated in FIG. 3.

Photosensitive member drums 1 was composed of a zinc oxide photosensitive member wound around a drum and bore negatively charged electrostatic latent images produced by charging means 2 and optical means 3. The latent image potential was −550 V at dark portions and −40 V at light portions.

In developing device 4, a toner layer of 50–70 microns in thickness was formed on the surface of inorganic semiconductor layer **7*b* of toner dispensing member 7 in a form of a magnetic sleeve by magnetism and the toner dispensing member was rotating in such a way that said member passed, near the photosensitive member drum. The gap between toner dispensing member 7 and photosensitive member drum 1 was 120 microns and toner particles were subjected to jumping phenomena directed to the latent images. Further, the surface of toner dispensing member 7** was prepared by vapor-depositing selenium of 0.5 microns in thickness on the surface of an aluminum substrate and then heating at 110° C. for 10 minutes to convert to polycrystal selenium.

For comparison, a toner dispensing member in a form of sleeve composed of an aluminum substrate only without forming a surface layer composed of polycrystal selenium.

The above mentioned toner dispensing members were used to develop latent images and the resulting developed images were transferred to ordinary paper by a negative corona charging device 11.

When a toner dispensing member having a surface layer composed of polycrystal selenium was used, the images were sharp and bad maximum density of 1.20 and fog density of 0.05. On the contrary, when a toner dispensing member composed of an aluminum substrate only prepared for comparison was used, the images were not sharp and had maximum density of 0.32 and fog density of 0.06.

EXAMPLE 18

Repeating the coping procedure of Example 17 except that a toner dispensing member composed of a brass sleeve which surface was coated with a cuprous oxide layer deposited by Fehling reaction was used in place of the toner dispensing member of Example 17, there were obtained transferred images which were very sharp and had maximum density of 1.31 and fog density of 0.05.

EXAMPLES 19–22

100 Parts by weight of a 10% (by weight) solution of polyvinylpyrene in methylene chloride and 3 parts by weight of trinitrobenzene were mixed, agitated and evaporated to dryness followed by finely pulverizing. 10 Parts by weight of the resulting fine particles, 40 parts by weight of polystyrene (tradename, Piccolastic D-125, supplied by ESSO), 20 parts by weight of magnetite (tradename, EPT 1000, supplied by Toda Kogyo), and 1 part by weight of carbon black (tradename, Regal 400R, supplied by Cabot) were melted and kneaded and finely divided to an average particle size of 11.5 microns to produce a toner.

The procedures of Example 17 were repeated by using the toner thus produced and a copying machine having a toner dispensing member as shown in Table 4 below. The resulting transferred images had maximum density and fog density as shown in Table 4.

TABLE 4

| Example No. | Surface layer of toner dispensing member (inorganic semiconductor) | Image quality | |
|---|---|---|---|
| | | Maximum density | Fog density |
| 19 | p-type cadmium telluride | 1.12 | 0.06 |
| 20 | p-type silicon | 1.25 | 0.06 |
| 21 | p-type lead sulfide | 1.22 | 0.05 |
| 22 | p-type copper sulfide | 1.18 | 0.05 |

What we claim is:

1. In a process for developing electrostatic images comprising:

(1) generating an electrostatic latent image of a first polarity on an electrostatic latent image bearing surface; (ii) providing a developer carrying member having an outer surface in a spaced apart opposed relation to said image bearing surface; (iii) introducing on the surface of said developer carrying member a particulate developer the improvement comprising:

(a) providing a particulate developer containing an organic semi-conductor, said semi-conductor available on the outer surface of said developer, said developer adapted to be insulating at a normal state and charged under the influence of an electric field, and (b) providing a surface for said developer carrying member formed from a material which has a negative contact potential with respect to gold, and (c) developing said latent image by positioning the surface of said developer carrying member bearing said particulate developer in said opposed relation to said image bearing surface, whereby an electric field forms between the electrostatic latent image bearing surface and the developer carrying member, said field inducing both the injection of electric charges in the developer of opposite polarity to the electrostatic latent image and the resulting attraction of said charged developer to said latent image bearing surface.

2. A process according to claim 1 in which the developer is preliminarily maintained on the surface of the developer carrying member by magnetic attraction.

3. A process according to claim 1 in which the electrostatic latent image bearing surface is positioned at a distance of from 50 microns to 5 mm. from the surface of the developer carrying member.

4. A process according to claim 1 in which the developement is carried out by contacting or not contacting the developer with the electrostatic latent image bearing surface.

5. A process according to claim 1 in which not less than 0.1 part by weight of the organic semiconductor is used per 100 parts by weight of a binder resin.

6. A process according to claim 1 in which the organic semiconductor is a member selected from the group consisting of vinylcarbazoles and mixtures of vinylcarbazoles.

7. A process according to claim 1 in which the organic semiconductor is a member selected from the group consisting of aminopolyphenyl, arylazines, N,N'-dialkyl-N,N'-dibenzylphenylenediamine, N,N,N',N'-tetrabenzyl-p-phenylenediamine, N,N'-diphenyl-p-phenylenediamine, N,N'-dinaphthyl-p-phenylenediamine, 4,4'-bis-dimethylaminobenzophenone and mixtures thereof.

8. A process according to claim 1 in which the organic semiconductor is a member selected from the group consisting of diphenylmethane dye leuco base, triphenylmethane dye leuco and mixtures thereof.

9. A process according to claim 1 in which the organic semiconductor is a member selected from the group consisting of oxadiazole, ethyl carbazole, N-n-hexylcarbazole, 5-aminothiazole, 4,1,2-triazole, imidazolone, oxazole, imidazole, pyrazoline, imidazolidine, polyphenylene thiazole, 1,6-methoxy-phenazine, bis-(N-carbazole)-alkane derivatives, and pyrazolinopyrazoline derivatives, benzothiazole, benzimidazole, 2-(4'-diaminophenyl)-benzoxazole, 2-(4'dimethylaminophenyl) benzoxazole and like benzoxazoles, aminoacridine, quinoxaline, diphenylene hydrazines, pyrrocoline derivatives, 9,10-dihydroanthracene derivatives, acrylhydrazone ethylene derivatives, 1,1,6,6-tetra-phenyl-hexatriene, and 1,1,5-triphenyl-pent-1-en-4-in-3-ol, condensation products of aldehydes and aromatic amines, reaction products of secondary aromatic amines with aromatic halogenated compounds, polypyrromethanoimide, and poly-p-phenylene-1,3,4-oxadiazole, and mixtures thereof.

10. A process according to claim 1 in which the organic semiconductor is a member selected from the group consisting of $\alpha$-alkylacrylic acid amide polymers, polyvinyl acridine, poly-[1,5-diphenyl-3-(4-vinylphenyl)-2-pyrazoline], poly(1,5-diphenylpyrazoline), polyacenaphthylene, nuclear substituted polyacenaphthylene, polyvinyl anthracene, poly-2-vinyldibenzothiophene, p-bis(2-phenyl-4-thiazolyl) benzene, 2,4-bis-[4-(2-phenyl-4-thiazoyl)-phenyl]thiazole, 1,4-bis[4-{4-(2-phenyl-4-thiazolyl)-phenyl}thiazolyl]benzene, and mixtures thereof.

11. A process according to claim 1 in which the organic semiconductor is a member selected from the group consisting of perylene pigments, anthraquinone pigments, thioindigo pigments, dioxane pigments, quinacridone pigments, azo pigments, phthalocyanine pigments, and mixtures thereof.

* * * * *